United States Patent [19]

Carnegie, deceased et al.

[11] Patent Number: 4,597,387

[45] Date of Patent: Jul. 1, 1986

[54] DEEP DIVING APPARATUS

[76] Inventors: Alistair L. Carnegie, deceased, late of Yeovil; by Norma E. Carnegie, executrix, 247 Mudford Road, Yeovil, Somerset, both of England

[21] Appl. No.: 544,987

[22] Filed: Oct. 24, 1983

[30] Foreign Application Priority Data

Oct. 25, 1982 [GB] United Kingdom ..... 8230432

[51] Int. Cl.[4] ..... B03C 11/02

[52] U.S. Cl. ..... 128/201.27; 128/205.24

[58] Field of Search ..... 128/201.27, 201.28, 128/205.26, 205.24

[56] References Cited

U.S. PATENT DOCUMENTS

| | | | |
|---|---|---|---|
| 3,859,994 | 1/1975 | Almquist et al. | 128/201.27 |
| 3,965,892 | 6/1976 | Colston et al. | 128/201.27 |
| 3,968,795 | 7/1976 | O'Neill et al. | 128/201.27 |
| 4,137,912 | 2/1979 | O'Neill | 128/201.27 |
| 4,195,628 | 4/1980 | Lubitzsch et al. | 128/201.27 |
| 4,442,835 | 4/1984 | Carnegie | 128/205.24 |
| 4,450,837 | 5/1984 | Ream | 128/201.27 |
| 4,454,878 | 6/1984 | Morrison | 128/201.27 |

FOREIGN PATENT DOCUMENTS

| | | | |
|---|---|---|---|
| 1093392 | 11/1967 | United Kingdom | 128/201.27 |

*Primary Examiner*—Henry J. Recla
*Assistant Examiner*—Karin M. Reichle
*Attorney, Agent, or Firm*—Larson and Taylor

[57] ABSTRACT

A pressure regulatory valve system for a breathing system in a deep diving apparatus comprises a pair of pressure relief valves, one adapted for connection to a gas supply line extending from a source of breathable gas provided by a diving bell to the diving helmet of a diver working out of the bell, and the other being adapted for connection to a gas return line extending from the diving helmet to the bell. The relief valves are adapted to be controlled by differences between the pressure in the helmet and the pressure in the bell so that when the diver moves to levels above that of the bell the relief valve connected to the supply line responds to reducing helmet pressure in an opening manner and vents gas from the supply line to the bell, while the relief valve connected to the return line responds in a closing manner. When the diver moves to levels below that of the bell the return line relief valve responds to increasing helmet pressure in an opening manner to allow gas to pass from the bell into the return lines and the supply line relief valve moves towards closing to raise the supply line pressure. This action of the pressure regulatory valve systems enables the pumps of a push-pull pump system circulating the breathable gas between the bell and the helmet to operate at substantially the optimum pressure rise for the pertaining ambient pressure conditions as sensed in the helmet.

4 Claims, 7 Drawing Figures

DEEP DIVING APPARATUS

THIS INVENTION relates to deep diving apparatus of the type comprising a diving bell from which a diver receives life and environmental support via umbilical connections and is particularly concerned with breathing systems, for such deep diving apparatus, in which gas is supplied to and withdrawn from the helmet of a diver by a push-pull pump.

A deep diving breathing system incorporating a push-pull pump for circulating a breathable gas mixture including helium through the system by way of the diver's helmet provides a recirculation system whereby the loss of helium from the system is minimal. However, an operational problem arises in regard to gas conservation when the diver is operating out of a diving bell which provides the breathable gas source for the push-pull pump. During vertical excursions the pressure difference across the wall of the diver's helmet is maintained substantially constant by means of a return pressure control valve; however the absolute pressure within the helmet varies with the depth at which the diver is located. Consequently, at levels increasingly below that of the bell the absolute pressure and thus the density of the gas in the helmet increase relative to that in the bell and at levels increasingly above the bell reverse conditions occur.

Thus, as the diver rises above the level of the diving bell the required gas pressure in the diver's helmet falls below the pressure in the bell so that gas delivered by the push pump expands on entering the helmet, eventually attaining a volume beyond the capacity of the pull pump to return to the bell and requiring provision of arrangements to relieve the excess pressure that would otherwise develop in the diver's helmet. In view of the high cost of helium, it is uneconomic to allow the excess gas to be discharged to the sea by a pressure relief valve on the helmet.

Our U.S. Pat. No. 4,442,835, issued Apr. 17, 1984 discloses a deep diving breathing system that aims to overcome this problem, the system of that patent including helmet pressure control means comprising inlet valve means for controlling flow of gas from a gas supply line into the helmet, outlet valve means for controlling the flow of gas from the helmet to a gas return line and bleed valve means operable in response to the difference in pressure of gas flowing from the outlet valve means and water pressure ambient to the helmet, i.e. absolute pressure, for bleeding gas from the gas supply line upstream of the inlet valve means when the absolute pressure in the helmet is less than that in the bell.

Whilst this system provides highly effective means of conserving expanded breathable gas, by preventing such gas from being discharged to ambient as a diver makes excursions to and from locations above the diving bell, this system requires a relatively large bleed hose in the umbilical and is somewhat uneconomic in meeting the power requirements of both the pressure side and of the suction side of the push-pull pump in contending with the line-losses and the varying pressure/suction requirements in delivering gas to and returning gas from the diver's helmet as he moves from one level to another, above and below the bell.

When the diver is operating below the diving bell the pressure of the gas fed by the pump to the supply line must accommodate the total pressure loss within the umbilical conduit system (line losses) plus the difference in ambient pressure between the location of the diver and that of the bell. However, when the diver is operating above the bell, the difference in ambient pressure between their respective locations compensates line losses so that the supply line pressure requirement is less. The suction-pressure at the pump for the return gas is also affected by the relative location of the diver and the bell, but inversely in comparison with that of the supply gas pressure and must accommodate the line losses plus the ambient pressure difference when the diver is above the bell, and the line losses minus the ambient pressure difference when he is below the bell.

With one exception, in all the contemporary push-pull pump systems known to us, the supply gas relief valve and the return gas relief valve, which respectively determine the pressures at the pump ends of the supply and return lines, are normally set to accommodate the maximum pressures required in moving both the supply gas and return gas to and from the helmet by the push-pull pump, as dictated by the maximum permitted vertical operational locations above and below the diving bell that the diver may reach during an excursion therefrom. This means that under conditions where the diver's location is intermediate the highest and the lowest, relative to the bell, at least one of the pumps of the push-pull pump is operating at a higher pressure rise, and drawing more driving power, than that which is actually required.

The exceptional system known to us is that disclosed in U.S. Pat. No. 3,965,829, in which it is proposed that push-pull pump means having the capacity to return all the gas to the bell from the helmet during any part of a diver's excursion above the bell shall include valve means that off-load the pull pump in conditions of less than maximum operating load.

More explicitly, a system according to U.S. Pat. No. 3,965,829 provides, within the diving bell a control valve in the gas return line for minimizing the power requirement of the return pump. This valve controls the negative pressure in the return line in response to the difference in pressure between the supply line and the return line. Preferably, the system also includes, within the bell, a regulating valve for maintaining the volume rate of flow to the supply line from the push-pump at a substantially constant value. The regulating valve operates in response to the difference in pressure across a flow restrictor positioned adjacent thereto at its connection to the supply line.

A breathing system such as disclosed in U.S. Pat. No. 3,965,829 provides control of pressure in the helmet that affords breathing conditions that are acceptable to the diver at, substantially, only one preselected level relative to that of the bell. In one practical utilisation of such a system breathing system has been developed in which the regulating valve is provided with a means of manual adjustment whereby the volume rate of flow of gas supplied to the helmet may be varied or reset by a supervisor in the bell. This enables more acceptable breathing conditions to obtain in the helmet for different levels at which the diver may be working, but requires that the relative levels of the diver and bell are known to the supervisor and continually monitored by him for wholly successful adjustments to be made.

However even the most practised supervisor would be unable to make the continual fine adjustments necessary to correct for the slight variations in absolute pressure in the diver's helmet as he changes his body attitudes and shifts his position while working, and whilst the diver would not consciously notice these slight variations and the consequential changes in his breathing effort, it being instinctive, for example, to reduce the depth of breathing while increasing the rate in response to an increase in gas density, they nevertheless tax his strength slightly and in consequence reduce the period for which he can sustain a constant workload.

The present invention aims to provide a pressure regulatory valve system for a deep diving apparatus breathing system which will substantially overcome these problems and especially that of excessive power being drawn by the pumps of a push-pull pump system during much of the working schedule of a diver when operating from a diving bell, while automatically providing in the diving helmet optimal conditions for breathing.

According to the present invention a pressure regulatory valve system for relief of overpressure in a gas supply line extending from a gas source on a diving bell to the diving helmet of a diver working outside the bell, and underpressure in a gas return line extending from the diving helmet to the bell, a breathing system in a deep diving apparatus, comprises a pair of pressure relief valves, one of said valves being adapted for connection to said gas supply line and the other said valve being adapted for connection to said gas return line, said pressure relief valves respectively being adapted to vent to and from the bell and to be controlled by differences between the pressure in the diving helmet and the pressure in the diving bell, respectively, so as to maintain respective supply and return line pressures individually appropriately related to the respective helmet and bell pressures.

With such a system, when the diver is at the same level as the bell, the relief pressures of the two relief valves are at substantially the same value. However, as the diver moves to levels above that of the bell from which he is operating, the relief valve connected to the supply line and thus controlling communication between the supply line and the bell interior (bell pressure) responds to reducing helmet pressure in an opening manner, while the relief valve connected to the return line responds in a closing manner. On the other hand, if the diver moves to levels below the bell the return line relief valve responds to the increase in helmet pressure by further opening the communication with the bell interior whilst the supply line relief valve moves towards closing to raise the supply line pressure as required. Such action on the part of the pressure regulatory valve system enables the pumps of the push-pull pump to operate at substantially the optimum pressure rise for the pertaining ambient pressure conditions as sensed in the diver's helmet.

The present invention also resides in a breathing system for deep diving apparatus comprising a diving bell providing a source of breathable gas for a diver working out of said bell, said breathing system including a push-pull pump for circulating breathable gas between the bell and a diving helmet via gas supply and gas return lines, and valve means in the vicinity of the diving helmet for maintaining the gas pressure therein at a value related to the ambient water pressure, characterised by a pressure regulatory valve system for relieving overpressure in the said gas supply line and underpressure in the said gas return line, such regulatory valve system comprising a pair of pressure relief valves, one connected to the gas supply line and adapted to vent gas therefrom to the bell, and the other connected to the gas return line and adapted to admit gas thereto from the bell, said relief valves respectively being controlled by differences between the pressure in the diving helmet and the pressure in the diving bell, respectively, so as to maintain respective supply and return line pressures individually appropriately related to the respective helmet and bell pressures.

An embodiment of the invention will now be described by way of example and with reference to the accompanying drawings in which.

Figure 1:
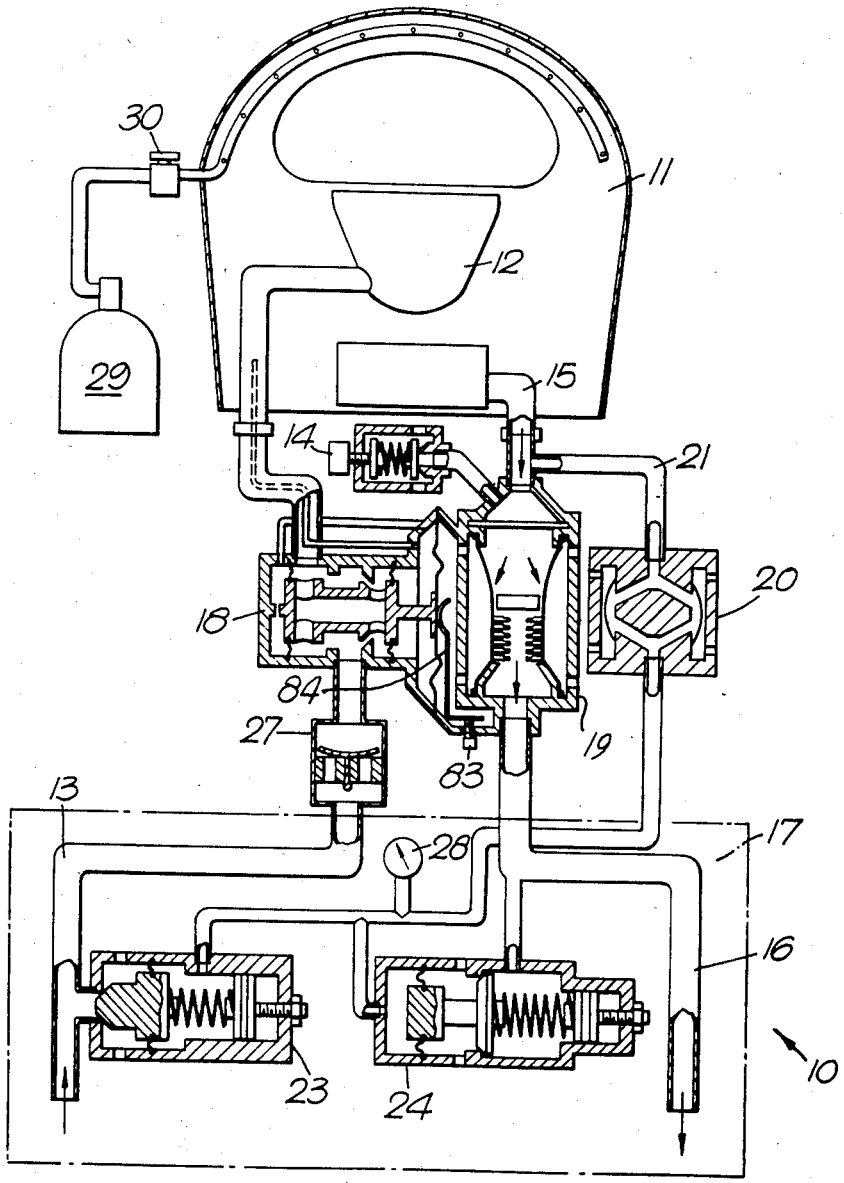
FIG. 1 is a schematic representation of a diving helmet, diving bell and appropriate pressure and flow control means in a deep diving apparatus breathing system having a pressure regulatory valve system in accordance with one embodiment of the invention.

FIG. 1 illustrates a deep diving apparatus breathing system 10 that includes a diving helmet 11 having an inlet valve means, an outlet valve means, and shut-off valve means associated with it and situated on, or in the close vicinity of, the helmet 11. The helmet has an inlet deflector 12 terminating a breathable gas supply line 13 at its entry to the helmet 11, the other end of the supply line 13 being connected to the push pump of a push-pull pump assembly (not shown) that draws a breathable gas mixture from a source of gas on a diving bell 17. A manually adjustable pressure relief valve 14 branches from a helmet outlet connection 15, or from a gas return line 16 which extends from the outlet connection 15 to the pull pump of the push-pull pump assembly. The breathing system 10 further includes a pressure regulatory valve system that is housed within the diving bell 17 and is connected into the gas supply and return lines 13 and 16 for the purpose of preventing unnecessary pressure rises in the push and pull pumps while being responsive to the diver's breathing state.

In this embodiment the inlet valve means comprises an inlet flow control valve 18 included in the supply line 13, the outlet control valve means, which controls pressure in the helmet 11, comprises an outlet gas flow pressure regulator valve 19 included in the return line 16 close to the connection 15, and the shut-off valve means comprises a self functioning safety valve 20 disposed in a helmet pressure sensing line 21 which is tapped into the return line 16, at the entry to the outlet gas flow pressure regulator valve 19.

The pressure regulatory valve system comprises a pair of pressure relief valves 23, 24 connected in a manner such that the relief valve 23 controls communication between the supply gas line 13 and the interior of the bell 17 and the relief valve 24 controls communication between the return gas supply line 16 and the interior of the bell. The helmet pressure sensing line 21 connects with a datum pressure control chamber of each of the relief valves 23, 24.

A non-return valve 27 is preferably included at the inlet to the inlet flow control valve 18, whilst an optional pressure responsive indicator 28 tapped into the helmet pressure sensing line 21 indicates within the bell the vertical position of the diver. At least one bottle 29, containing pressurised breathable gas, is connected to the helmet 11 by way of a manually operated control valve 30 to provide an emergency breathable gas supply for enabling the diver to return to the bell in the event of a failure of the system feeding gas via the supply line 13.

Figure 2:
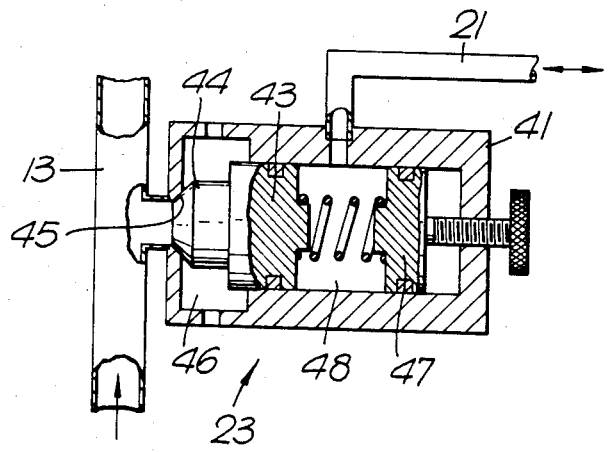
FIGS. 2 and 3 are schematic illustrations of the pressure relief valves for controlling supply line and return line pressures respectively, in the deep diving apparatus breathing system of FIG. 1.
Figure 3:
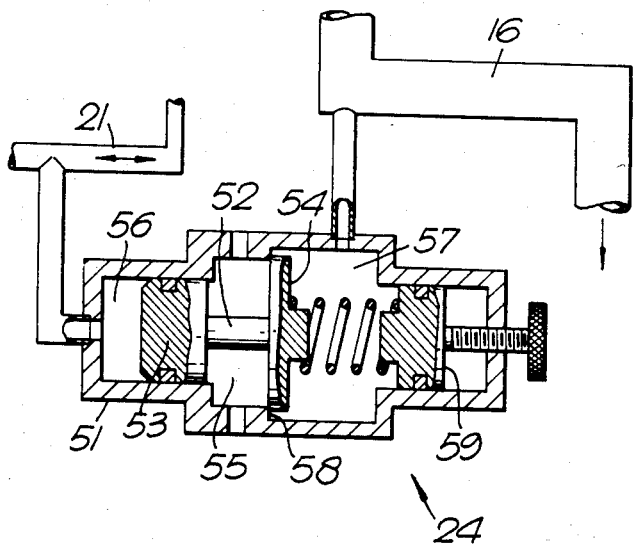

The relief valves 23 and 24 may be provided by valves of the simple poppet form shown in FIGS. 2 and 3, in which a valve head moves to open against a closing force that is pneumatically and automatically variable.

Referring to FIG. 2, the breathable gas supply relief valve 23 in this embodiment comprises a hollow valve body 41 within which a poppet-type valve member 43 is constrained to slide. This valve member 43 has a body portion carrying a sealing ring in slidable contact with the interior surface of the valve body 41 and a valve head 44 which is co-operable with a valve seat 45 arranged axially of and in one endwall of the body 41. The valve head 44 spans a ported relief chamber 46 communicating with the interior of the bell 17 and is urged towards seating on the valve seat 45 by a compression spring of appropriate rate that is reacted against a spring adjuster 47 slidably located in a leakproof manner within the valve body 41 and adjustable by a turnscrew carried in the other endwall. The valve seat 45 circumscribes a conduit connection with the breathable gas supply line 13 so that the valve head 44, in co-operating therewith, can control a gas path connecting the supply line 13 to the interior of the bell 17 by way of the ported relief chamber 46. A conduit connection on the valve body 41 connects the helmet pressure sensing line 21 with a datum pressure chamber 48 formed within the valve body 41 between the valve member 43 and the spring adjuster 47 so that helmet pressure supplements the spring force tending to close the valve.

Referring to FIG. 3, the return gas relief valve 24 has a hollow body 51 of generally stepped cylindrical form that contains a valve member 52 comprising a piston 53 and a valve head 54 which are spaced apart by an annular undercut section. The valve body 51 provides a datum pressure chamber 56 for the piston 53 and a relief chamber 57 that is divided by a wall having an annular seat 58, with which the valve head 54 co-operates. The datum pressure chamber 56 is connected to the helmet pressure sensing line 21 whilst the relief chamber 57 is connected, on the side of the valve head 54 remote from the datum pressure chamber 56, with the gas return line 16, and on the other side of the valve head 54 with the interior of the bell. The valve head 54 thus controls a gas path connecting the return line 16 to the interior of the bell 17 by way of the relief chamber 57. The valve head 54 is urged towards seating on the valve seat 58 by a compression spring of appropriate rate that is reacted against a spring adjuster 59 which is slidably located in a leakproof manner in the body 51 and adjustable by means of a turnscrew carried in an endwall of the body 51.

FIG. 1 shows a modification of the relief valves 23, 24 illustrated in FIGS. 2 and 3, in which, the sealing rings carried by the body portions of the valve members 43, 52 respectively are replaced by rolling diaphragms connected between the body portions of the valve members and the internal surfaces of the valve bodies 41, 51, respectively.

The compression springs urging the respective valve heads 44 and 54 towards seating in the relief valves 23 and 24, respectively, are of such a rate as to ensure that, together with the pneumatic load effected by the sensed helmet pressure, the required maximum pressure rise is developed in the push pump when the diver is, at his lowest permitted location relative to the bell 17 and, likewise the required maximum pressure rise is developed in the pull pump when the diver is at his highest permitted location relatively to the bell: whereas when the diver is substantially at the level of the bell the minimum pressure rise in the pumps sufficient to overcome line losses is obtained.

Figure 4:
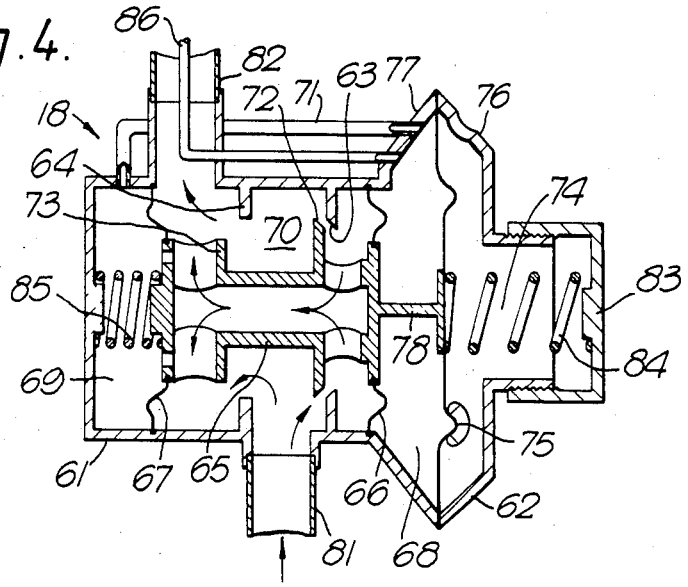
FIGS. 4, 5 and 6 are schematic illustrations of helmet inlet valve means, helmet outlet valve means and a sensing line safety valve means, respectively, of the deep diving apparatus breathing system of FIG. 1.

The inlet flow control valve 18, as used in this embodiment, is provided by a pressure balanced valve which in general terms is a combination poppet and spool valve having a pressure datum reference obtained from the ambient water pressure. One form of this valve is shown in FIG. 4, the inlet flow control valve 18 of that Figure being similar to that disclosed in our U.S. Pat. No. 4,442,835, issued Apr. 17, 1984, and comprising a hollow valve body 61 having a differential pressure-sensing device 62 attached to one end.

The hollow body 61 interiorly provides, in axial spaced relationship, an annular valve seat 63 and an annular land 64. A lightweight combination poppet and spool valve member 65 is freely supported within the body 61 by two impermeable flexible membranes 66, 67 that are disposed outboard of the annular valve seat 63 and land 64, respectively. The membrane 66 closes one end of the body 61 and provides part of a wall of a control pressure chamber 68 of the pressure-sensing device 62, whilst the membrane 67 provides a wall separating a balancing chamber 69 from a flow chamber 70 formed between the two membranes 66, 67. The control pressure chamber 68 and the balancing chamber 69 are interconnected by a balancing duct or tube 71. The combination valve member 65 provides a valve head 72 and a raised annular land 73 that are co-operable, respectively, with the valve seat 63 and the annular land 64 provided within the flow chamber 70.

The pressure-sensing device 62 comprises a differential pressure chamber formed by the control pressure chamber 68 and an ambient (immersing water) pressure chamber 74, which two chambers are separated by an impermeable flexible diaphragm 75 that is peripherally trapped between the rims of a perforated cover 76 and a flared portion 77 of the valve body 61. The valve member 65 is mechanically secured to the diaphragm 75 by a stud arrangement 78 that spans the control chamber 68 as an axial extension of the valve member 65.

When the valve head 72 is seated the land 73 is just entered within its associated land 64 of the flow chamber 70. A small radial clearance is provided between the lands 64, 73. The valve member 65, within the length of the flow chamber 70, is of hollow construction and has cross drillings at each end outboard of the valve head 72 and land 73.

An inlet 81 for connection to the breathable gas supply line 13 is provided in the wall of the body 61 at a position between the valve seat 63 and the land 64, whilst an outlet 82 is positioned in the wall to the side of the land 64 remote from the seat 63. The perforated cover 76 carries a threaded spring adjuster 83 that is aligned with the axis of the valve member 65 and holds a low rate compression spring 84 against the stud arrangement 78. Another low rate compression spring 85 may be provided in the balancing chamber 69 in axial opposition to spring 84. A helmet pressure sensing tube 86 is connected to the control pressure chamber 68.

Figure 5:
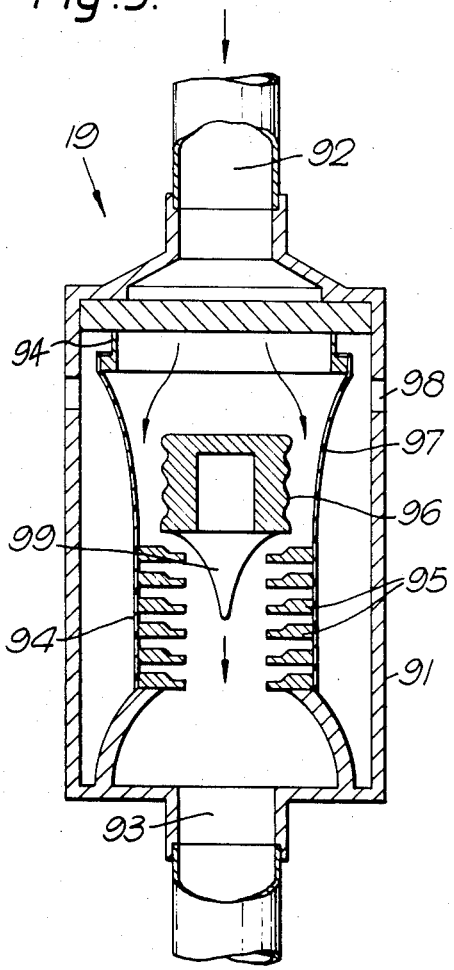

The outlet gas flow pressure regulator valve 19 in this embodiment may be provided by an anti-suction valve, of the form shown in FIG. 5 , which may be similar in detailed construction to the gas flow regulator valve disclosed in our UK Patent Application GB 2088726A published June 16,1982. The outlet gas flow pressure regulator valve 19 shown in FIG. 5 comprises a rigid outer body member 91 of tubular form, having an inlet end 92 and an outlet end 93. Housed within the outer body member 91 is a tubular member 94 having radial slots which provide a weir-like flow path towards the outlet end 93. The tubular member 94 comprises a plurality of weir elements 95 each formed by an annular plate having one plain face and one face provided with two raised rings (not shown) that are concentric with the axis of the plate. The weir elements 95 are secured by equally spaced bolts and spacer means (not shown) to form between their opposed faces a plurality of slots which provide radial flow paths between the exterior and interior of the tubular member 94. The bolts (not shown) pass through the outlet end 93 and the weir elements 95 into threaded engagement with a member 96 which closes that end of the tubular member 94 facing the inlet end 92 of the body 91. A thin shim plate 99 formed to the curvature of the outside diameter of the weir elements 95 is secured thereto so as to occlude a small arcuate area of the entry to each of the slots formed between the weir elements. A thin elastomeric tubular sleeve 97 of substantially the same diameter as the outside diameter of the weir elements 95 is fitted about them and is stretched between the inlet end 92 and the outlet end 93 at which ends it is secured by suitable clamping means (not shown). This sleeve 97 is arranged to lift from the tubular member 94, when in use, by the pressure rise in the helmet created by a diver's exhalation in breathing. The outer body member 91 is perforated by holes 98 so that absolute (immersing water) pressure is effective on the outer surface of the elastomeric sleeve 97 to hold it in contact with the tubular member 94 whenever the pressure within the member 94 is less than the ambient water pressure.

For the best performance of the system of the present invention it is preferred in practice to integrate the structures of the inlet flow control valve 18 and the outlet gas flow pressure regulator valve 19 so that by very close positional relationship of their pressure sensing elements they respond to, substantially, the identical absolute ambient pressure and conveniently operate as a single rigid valve unit as represented in FIG. 1. To facilitate integration and close positioning of the respective valves 18, 19 it is useful to modify the means shown in FIG. 4 for adjusting the low rate spring of the inlet flow control valve 18 by arranging that the threaded spring adjuster 83 acts through spring 84 in the form of a cranked lever (FIG. 1) whereby the spring adjuster 83 can be positioned in a sidewall of the integral structure.

Figure 6:
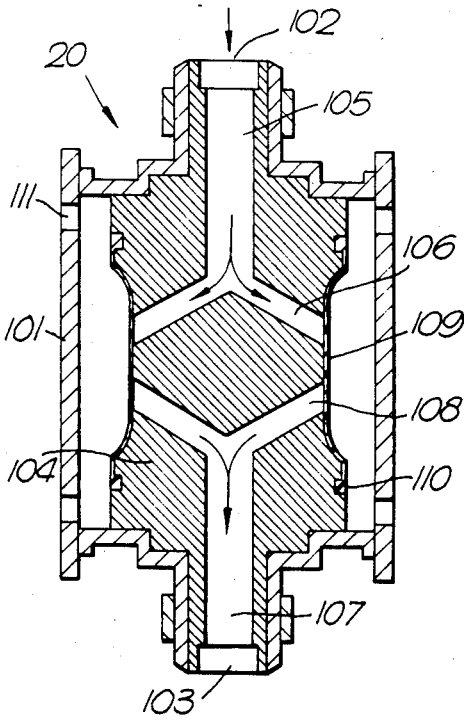

The safety valve 20 in this embodiment is similar in principle to the associated outlet gas flow regulator valve 19, being in the form of an anti-suction valve utilising an impermeable sleeve over a perforated tube. Tnus as shown in FIG. 6, the safety valve 20 comprises a rigid tubular outer body member 101 providing connections 102, 103 for inclusion in the helmet pressure sensing line 21 (FIG. 1). Housed within the outer body member 101 is a waisted body element 104 of circular transverse cross-section which is provided with two sets of internal ducts 105, 106, and 107, 108 of which the ducts 105, 106 join the connection 102 with the periphery of the body whilst ducts 107, 108 similarly join the connection 103 with the periphery of the body. A thin elastomeric tubular sleeve 109 of substantially the same diameter as the outside diameter of the waisted portion of the body element 104 is fitted thereon and retained at each end thereof by suitable retention means 110. The outer body member 101 is perforated by holes 111 so that immersing water pressure can be effective on the outer surface of the elastomeric sleeve 109 to hold this in contact with the body element 104.

In operation of this embodiment, assuming that the breathable gas supply line 13 and the gas return line 16 are appropriately and respectively connected to the push and the pull pumps of a push-pull pump (not shown), breathable gas is delivered to the helmet 11 by the push pump by way of the supply line 13 which includes the inlet flow control valve 18 and a non-return valve 27. Gas is returned to the pull pump from the helmet 11 by way of the gas return line 16 and the outlet gas flow pressure regulator valve, or anti-suction valve, 19. The non-return valve 27 prevents back flow from the inlet control valve 18 in the event of a failure of the supply hose. The pressure relief valve 14 prevents pressure rising in the helmet above a predetermined level of, say, 2.76 kPa (0.4 psi) above ambient pressure. Sensing of the gas pressure within the helmet 11 is obtained in the respective datum pressure chambers 48 and 56 of the two relief valves 23 and 24 by way of the helmet pressure sensing line 21 which includes the safety valve 20. The safety valve 20 is situated in the vicinity of the helmet 11 and whilst permitting flow in either direction ensures that, should the helmet pressure sensing line 21 become ruptured while the diver is below the bell, gas will not flow from the helmet to the extent of causing a depression therein.

Breathable gas passes through the inlet flow control valve 18 to the helmet 11 from the supply line 13, entering and leaving this valve by connections 81, 82 (FIG. 4) respectively. Helmet pressure obtains in the pressure chamber 68, being sensed by way of the sensing tube 86 and is effective upon the diaphragm 75 so as to oppose ambient pressure applied by the immersing water in chamber 74. Helmet pressure is also effective upon the spool-supporting membranes 66 and 67 by way of balancing tube 71, whereby the spool is axially balanced. The diaphragm 75 responds to ambient pressure and to the effect of spring 84 which is adjusted to bias the combined poppet and spool valve 65 so as to seek to maintain a small positive datum pressure, determined by the anti-suction valve 90, in the helmet, relative to the ambient pressure. When the valve member 65 is in a steady controlling mode at constant depth it passes a small flow of gas to the helmet for ventilation of the diver. Even when the valve head 72 is seated upon its seat 63 a small (ventilation) flow through the valve 17 is ensured by way of the annular flow path between the two lands 64 and 73, so that the diver is not denied totally a supply of gas into the helmet at any time.

The ambient pressure is effective upon the elastomeric sleeve 97 of the anti-suction valve 19 by reason of immersing water entering the body through the holes 98 and tending to hold the sleeve 97 on to the tubular member 94, whereas helmet pressure is effective in the inlet end as far as the upstream end of the tubular member 94 at the face or the closure member 96. Pull pump suction pressure applies at the outlet end of the valve and interiorly of the slots formed between the annular elements 95 of the tubular member 94. The resistance to flow of this valve establishes a positive datum pressure in the helmet by predetermined relationship of the restrictive area of the slots and the tension of the elastomeric sleeve 97. In response to changes in helmet pressure, owing to the effect of inhalation and exhalation on the part of the diver, the open cross sectional area of the slots varies as the pressure difference across the elastomeric sleeve 97 varies accordingly within a working range.

As the diver rises or descends the ambient pressure on the elastomeric sleeve 97 respectively decreases or increases the clamping load holding it to the tubular member 94 and the helmet pressure consequently follows that of the ambient pressure while maintaining the positive datum pressure.

Obviously, the pressure and density of gas in the helmet 11 relative to that existing in the diving bell 17 is less when the diver is above the bell and greater when he is below the bell. Consequently the push pump delivering breathable gas from the bell 17 to the helmet 11 requires less power to accomplish this task, when the diver is at a level above the bell than when he is at or below the level of the bell. On the other hand, the pull pump requires more power and sufficient volumetric capacity to return gas to the bell, if gas is not to be wasted to ambient when the diver is above the bell than when he is at or below the level of the bell. These pump power requirements are obtained by operation of the relief valves 23, 24 as a consequence of helmet pressure being effective in the respective datum chambers 48 and 56 of the valves 23 and 24, as a variable datum reference pressure, and thereby regulating communication between the interior of the bell 17 and supply line 13 and return line 16.

The reference helmet pressure together with the effect of the compression springs urges the valve heads 44 and 54 of the relief valves 23, 24 respectively towards closing, such that when the differential pressure value is zero, or substantially so, (i.e. the diver and bell are at the same level) the two valves are open to an extent where gas is bled from the supply line 13 into the bell 17 and also therefrom into the return line 16 to an amount sufficient to off-load both the push pump and the pull pump to a condition where their power requirement is only that which is sufficient to contend with the line losses of the gas flow circuit.

As the diver rises above the level of the bell 17, the reference pressure obtaining in the datum chamber 48 of the supply gas relief valve 23 is reduced and consequently the combined closing pressure of this and the exertion of the compression spring in the chamber 48 reduces whereby, the valve tends to open, so that more gas from the supply line is allowed to pass into the interior of the bell 17 by way of the ported chamber 46 so as to relieve the pressure rise of the push pump and also reduce the amount of gas delivered to the helmet to match the lower density of the gas at helmet pressure. The reduced helmet or reference pressure, being present also in the datum chamber 56 of the gas return relief valve 24, is effective upon the piston 53 therein and provides reduced opposition to the force exerted by the compression spring housed in relief chamber 57 such that the combined force of the sensed pressure and the spring produce a greater force on the valve member 52 towards closing its valve head 54 on to seat 58. This reduces or prevents gas flow from the bell 17 to the pull pump by way of the ported relief chamber 55, relief chamber 57 and duct 16, thereby enabling the pull pump to develop a greater pressure rise as required to contend with the reduced density of the gas in the return line.

On the other hand, when the diver moves to levels below the bell the effect of the two relief valves 23, 24 and the operation of their respective valve members 43 and 53 reverses. Increasing helmet or reference pressure sensed in the datum pressure chamber 48 causes the spring force in the gas supply relief valve 23 to be supplemented and so increasingly urge the valve head 44 towards contacting valve seat 45, thereby decreasing the relieving gas flow passing from the supply line 13 into the bell interior and causing increasing pressure rise of the push pump in order to overcome the increasing ambient pressure gradient between the bell 17 and the diver. The reference pressure sensed in the datum pressure chamber 56 of the valve 24 opposes the force of the compression spring in relief chamber 57 so that as the reference pressure increases the valve head 54 lifts and permits gas to pass from the interior of the bell 17 to the suction of the pull pump by way of ported relief chamber 55 and relief chamber 57, whereby the pressure rise of this pump is reduced and advantage taken of the decreasing ambient pressure gradient between the diver and the bell.

Thus the two relief valves 23, 24 operate in a manner relieving the working load on the pumps to that actually required of each one at the pressure conditions pertaining in the system and by directly sensing the pressure in the helmet the two valves are enabled to be more responsive to the difference in helmet absolute pressure and bell absolute pressure than in a system where the pressure difference is determined indirectly, such as by sensing the supply line and bell pressures. Because of the better responsiveness of the relief valves in systems according to the present invention, small pressure variations in the helmet caused by changes in the diver's breathing pattern are acted upon quickly and more accurately. Thus the supply of gas to the helmet is automatically maintained at, or very substantially, at, the optimum for the diver's breathing requirements over the full range of his permitted vertical excursions and changes of attitude and position in working.

Figure 7:
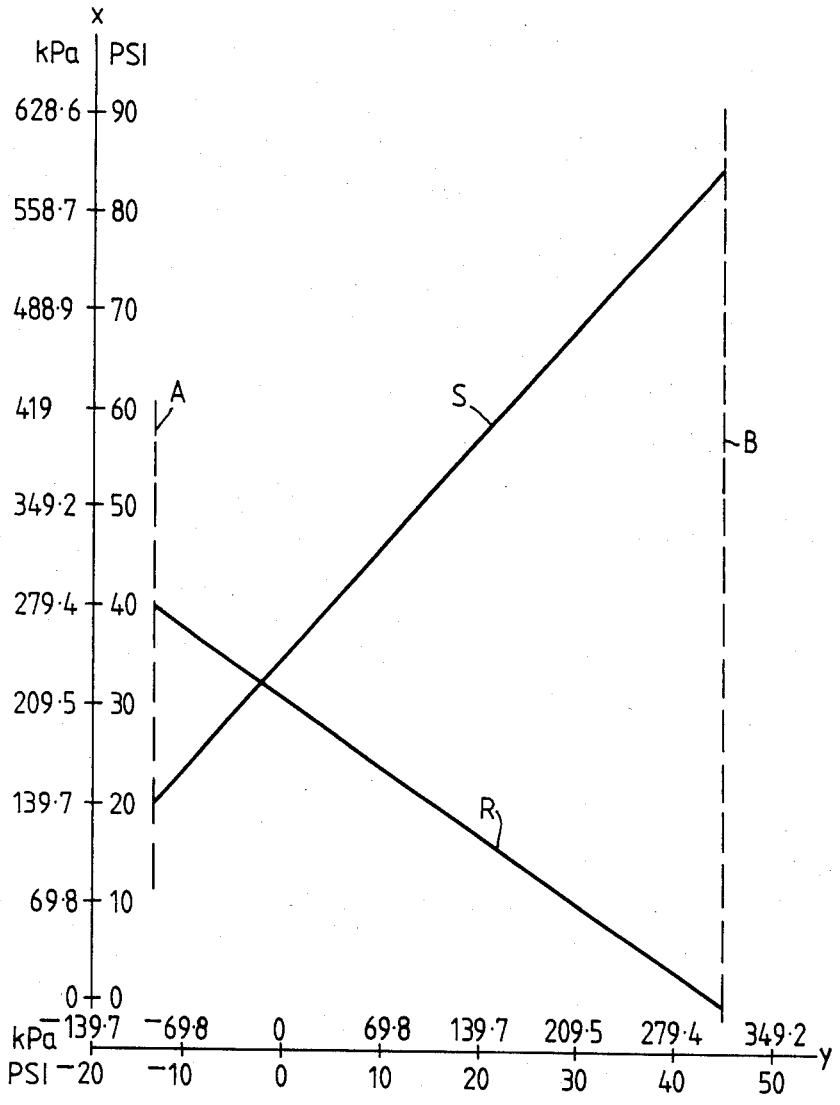
FIG. 7 is a graph showing relative relief pressure conditions of the relief valves through a vertical excursion range of a diver.

FIG. 7 is a graph illustrating typical datum pressure settings of the relief valves for a helmet to bell pressure difference range of −89.6 kPa (−13 psi) to +310.2 kPa (+45 psi), corresponding to a diver's vertical excursion between 9.1 meters (30 feet) above and 30.4 meters (100 feet) below a diving bell operating within its limits. The valve 23 for relieving gas flow from the supply line 13 opens at pressures within the range 137.8 kPa (20 psi) to 586 kPa (85 psi), whilst valve 24 for admitting gas into the return line 16 opens at pressures within the range 275.7 kPa (40 psi) to zero. When the diver and the bell are at substantially the same level both valves open to establish the same pressure value of 224 kPa (32.5 psi), which value is appropriate to the system line losses.

In the graph of FIG. 7, the 'x' axis represents pressure at which the relief valves 23, 24 relieve and the 'y' axis represents helmet pressure relative to bell pressure, the broken vertical lines 'A' and '8', respectively, representing the diver positions at 9.1 meters (30 feet) above and 30.4 meters (100 feet) below the bell. The sloping lines 'S' and 'R' indicate the relieving pressure values of the supply line pressure relief valve 23 and the return line pressure relief valve 24, respectively.

What is claimed is:

1. A pressure regulatory valve system for relief of overpressure in a gas supply line extending from a gas source within a diving bell to the helmet of a diver working underwater outside the bell and for relief of under pressure in a gas return line extending from the diver's helmet to the bell, the pressure regulatory valve system comprising, a pair of pressure relief valves including means adapted to be positioned within the diving bell, one of the relief valves including means adapted for connection to the gas supply line and the interior of the diving bell, a flow path through said one relief valve adapted to connect the gas supply line to the interior of the bell, the other relief valve including means adapted for connection to the gas return line and the interior of the diving bell, a flow path through said other relief valve adapted to connect the interior of the bell to the gas return line, a pressure datum chamber in each of said relief valves, means adapted to be connected with the diver's helmet and operatively connected with the pressure datum chambers in said relief valves for communicating the gas pressure in the diver's helmet with the pressure datum chambers, control means disposed in the flow paths of each of said relief valves and responsive to the gas pressure in the pressure datum chamber, the line and the diving bell for regulating the flow through said flow path overpressures in the supply line and overpressures in the return line are relieved to maintain the appropriate pressure in the diver's helmet at various depths with respect to the bell.

2. A pressure regulatory valve system as claimed in claim 1, wherein the pressure relief valve for the gas supply line comprises a hollow body housing and said control means includes a valve member slidable therein, a moveable wall operably connected to said valve member and said housing dividing said housing into two chambers; one of said chambers including said means adapted for a connection to the gas supply line and the interior of the bell and defining said flow path, the other of said chambers defining said pressure datum chamber, a valve seat positioned within said flow path, said valve member having a valve head portion positioned within said flow path between the valve seat and the interior of the bell, spring means acting on said valve member, the valve member being urged in opposition to the pressure in the gas supply line and to the pressure in the diving bell by the diving helmet pressure communicated to the datum chamber and by said spring means thereby urging the valve head portion towards said valve seat closing the flow path from the gas supply line to the interior of the bell.

3. A pressure regulatory valve system as claimed in claim 1, wherein the pressure relief valve for the gas return line comprises a hollow body housing and said control means including a valve member slidable therein, a movable wall operably connected to said valve member and said housing, the movable wall dividing the housing into two chambers, one of said chambers including said means adapted for connection to the gas return line and the interior of the bell and defining said flow path, the other of said chambers defining said pressure datum chamber, a valve seat positioned within said flow path, said valve member having a valve head portion positioned within said flow path between said valve seat and the return gas line, spring means acting on said valve member, the valve member being urged in opposition to the helmet pressure communicated to the datum chamber and to the pressure in the diving bell by the pressure in the return line and said spring means thereby urging the valve head protion towards the valve seat closing the flow path from the interior of the bell into the return line.

4. A breathing system for deep diving apparatus comprising:

a diving bell for providing a source of breathable gas;

a diver's helmet for a diver working underwater outside the bell;

a gas supply line and gas return line interconnecting the diving bell and diver's helmet;

a push-pull pump means for circulating breathable gas through said gas supply line and gas return line between the diving bell and the helmet;

valve means in the vicinity of the diver's helmet and operatively connected therewith for maintaining the pressure of gas therein at a value related to the ambient water pressures, a pressure regulatory valve system comprising a pair of pressure relief valves;

one of the relief valves being located within the diving bell and connected to the gas supply line;

a flow path through said one relief valve from the gas supply line to the interior of the bell;

the other relief valve being located within the diving bell and connected to the gas return line;

a flow path through said other relief valve from the interior of the bell to the gas return line;

a pressure datum chamber in each of said relief valves;

means operatively connected between the pressure datum chambers in said relief valves and the helmet for communicating the gas pressure in the diver's helmet with the pressure datum chambers;

control means disposed in the flow paths of each said relief valves and responsive to the gas pressure in the pressure datum chamber, the line and the diving bell for regulating the flow through said flow path whereby overpressures in the supply line and underpressures in the return line are relieved to maintain the appropriate pressure the diver's helmet at various depths with respect to the bell, wherein the pressure relief valve for the gas supply line comprises a hollow body housing and said control means includes a valve member slidable therein, a moveably wall operably connected to said valve member and said housing dividing said housing into two chambers; one of said chambers connected to the gas supply line and the interior of the bell and defining said flow path, the other of said chambers defining said pressure datum chamber, a valve seat positioned within said flow path, said valve member having a valve head portion positioned within said flow path between the valve seat and the interior of the bell, spring means acting on said valve member, the valve member being urged in opposition to the pressure in the gas supply line and to the pressure in the diving bell by the diving helmet pressure communicated to the datum chamber and by said spring means thereby urging the valve head portion towards said valve seat closing the flow path from the gas supply line to the interior of the bell, and the pressure relief valve for the gas return line comprises a hollow body housing and said control means includes a valve member slidable therein, a movable wall operably connected to said valve member and said housing, the movable wall dividing the housing into two chambers, one of said chambers connected to the gas return line and the interior of the bell and defining said flow path, the other of said chambers defining said pressure datum chamber, a valve seat positioned within said flow path, said valve member having a valve head portion positioned within said flow path between said valve seat and the return gas line, spring means acting on said valve member, the valve member being urged in opposition to the helmet pressure communicated to the datum chamber and to the pressure in the diving bell by the pressure in the return line and said spring means thereby urging the valve head portion towards the valve seat closing the flow path from the interior of the bell into the return line.

* * * * *